US006079195A

United States Patent [19]

Stahlecker

[11] Patent Number: 6,079,195

[45] Date of Patent: Jun. 27, 2000

[54] PROCEDURE FOR RE-EQUIPPING AND SIMULTANEOUS MODERNIZATION OF AN OPEN END ROTOR SPINNING MACHINE

[75] Inventor: Gerd Stahlecker, Eislingen/Fils, Germany

[73] Assignees: Fritz Stahlecker, Bad Uberkingen; Hans Stahlecker, Suessen, both of Germany

[21] Appl. No.: 09/296,274

[22] Filed: Apr. 22, 1999

Related U.S. Application Data

[63] Continuation-in-part of application No. 09/236,401, Jan. 25, 1999.

[51] Int. Cl.[7] ..... D01H 13/26

[52] U.S. Cl. ..... 57/263; 57/281; 57/269

[58] Field of Search ..... 57/263, 281, 268, 57/269

[56] References Cited

U.S. PATENT DOCUMENTS

| | | | |
|---|---|---|---|
| 4,125,990 | 11/1978 | Stahlecker et al. | 57/263 |
| 4,138,839 | 2/1979 | Stahlecker et al. | 57/270 |
| 4,539,803 | 9/1985 | Ferrro et al. | 57/263 |
| 4,920,739 | 5/1990 | Raasch | 57/263 |
| 5,676,322 | 10/1997 | Stahlecker | 242/18 PW |

*Primary Examiner*—William Stryjewski
*Attorney, Agent, or Firm*—Evenson McKeown Edwards & Lenahan, PLLC

[57] ABSTRACT

A procedure is described in which an open-end rotor spinning machine already in operation can be modernized by means of re-equipping it with new parts. This machine comprises device means for interrupting the spinning process at a spinning station for the purpose of a doffing operation. The machine comprises a doffing arrangement which is movable relative to the spinning stations, which doffing arrangement comprises devices for exchanging a full bobbin for an empty yarn-winding tube. The machine comprises further at least one piecing arrangement movable in relation to the spinning stations, which is designed to restart spinning at the spinning station with a starting winding already connected to the yarn-winding tube. It is an object of the modernization that the piecing arrangement is replaced with a new piecing arrangement, which is designed to restart spinning with a starting yarn which is not connected to the yarn-winding tube, and subsequently to attach a newly spun yarn to the yarn-winding tube. In the case of the new piecing arrangement any piecing point of the yarn after a doffing operation onto the bobbin is omitted. This results in an increase in bobbin quality. The piecing arrangement is also operable to perform piecing operation in case of a yarn break with a partially full bobbin, where yarn from the partially full bobbin is used for piecing.

8 Claims, 2 Drawing Sheets

39
29
38
39
63
62
64
P
60
47
61
46
45
Q
59
B
21
58
65
44
K
50
L
52
49
43
19
20
34
C
23
18
51
42
48
41
16
40
57
55
14
13
8
53
15
1
12
54
10
M
N
28
4
57

PROCEDURE FOR RE-EQUIPPING AND SIMULTANEOUS MODERNIZATION OF AN OPEN END ROTOR SPINNING MACHINE

CROSS-REFERENCE TO RELATED APPLICATIONS

This application is a continuation-in-part of U.S. application Ser. No. 09/236,401 filed on Jan. 25,1999.

BACKGROUND AND SUMMARY OF THE INVENTION

The present invention relates to a procedure for re-equipping and simultaneously modernizing an open-end rotor spinning machine comprising a plurality of spinning stations, a doffing arrangement which is movable relative to the spinning stations, which doffing arrangement comprises devices for exchanging a full bobbin for an empty yarn-winding tube, means for interrupting the spinning process of a spinning station for the purpose of a doffing operation, and at least one piecing arrangement movable relative to the spinning stations, which piecing arrangement is designed to restart spinning with a starting winding already attached to the yarn-winding tube.

Open-end rotor spinning machines of this type have been manufactured by the firm Schlafhorst Autocoro GmbH under the trademark "Autocoro" and are in use all over the world. The principle functions of this open-end rotor spinning machine "Autocoro" are disclosed in U.S. Pat. No. 4,125,990. In the known open-end rotor spinning machine, the doffing arrangement and the piecing arrangement travel independently of one another along the spinning stations. For the purpose of doffing operation, the spinning process is first interrupted at the relevant spinning station. The travelling doffing arrangement then exchanges bobbin of the relevant spinning station for a new empty yarn-winding tube. At a later point, the piecing arrangement travels to this spinning station and sets the spinning process in motion again. This piecing arrangement, which serves also to repair normal end breaks, requires for piecing a starting winding connected to the bobbin. In order that such a starting winding, which permits a piecing process, is also present in a newly applied tube, it is provided in the Autocoro machine that instead of empty tubes, ones with a piecing starting winding are used. Piecing after a doffing operation can thus take place in the same way as the piecing for repairing an end break. This fascinating method has the disadvantage that directly after each doffing operation the new yarn-winding tube comprises a piecing point. Even if such piecing points do not significantly impair the quality of a bobbin, they remain undesirable.

It is an object of the present invention to modernize the known open-end rotor spinning machines already in operation by reequipping them in such a way that the piecing point, in connection with a doffing operation, is omitted.

This object has been achieved according to the present invention in that the piecing arrangement is replaced by a new piecing arrangement which is designed: (i) for doffing operations to piece a starting yarn not connected to the empty yarn-winding tube, and subsequently to attach a newly spun yarn to the empty yarn-winding tube, and (ii) for piecing operations with a partially full yarn winding tube, where previously spun yarn from the yarn winding tube serves as the starting yarn.

This can occur, for example, in that the starting yarn to be pieced during doffing operations is connected to an auxiliary tube located in the new piecing arrangement, and that the auxiliary starting yarn is eliminated after piecing, whereafter the newly spun yarn is connected to the empty yarn-winding tube.

For piecing operations with a partially full bobbin, the starting yarn is taken from the previously spun yarn on the partially full bobbin.

The present invention is based in the first instance on the premise that, if re-equipping does take place, the doffing arrangement can be left where it is, as it is basically irrelevant for this arrangement whether it handles a completely empty new tube, or a new tube comprising a starting winding for piecing. As, however, the starting yarn to be pieced no longer comes from the newly applied tube, but rather from an auxiliary tube located in the piecing arrangement, the empty yarn-winding tube no longer contains the necessary piecing point that was previously the case using starting yarn fixed to the empty tube. This results in an improvement in bobbin quality in so far as that the subsequently full tube comprises one piecing point less than before. When the starting yarn for piecing which is connected to an auxiliary tube is preferably additionally eliminated, for example by means of suction, the result is an additional advantage wherein the piecing point itself places no demands whatsoever with regard to quality. It is sufficient to make a safety piecer, as the piecing point is removed after piecing.

A piecing arrangement, which fulfills the desired requirements is described, for example, in U.S. Pat. No. 5,676,322.

As noted above, the new piecing arrangement and procedure also facilitate piecing in case of yarn breaks with a partially full tube.

BRIEF DESCRIPTION OF THE DRAWINGS

These and further objects, features and advantages of the present invention will become more readily apparent from the following detailed description thereof when taken in conjunction with the schematic accompanying drawings wherein.

DETAILED DESCRIPTION OF THE DRAWINGS

Figure 1:
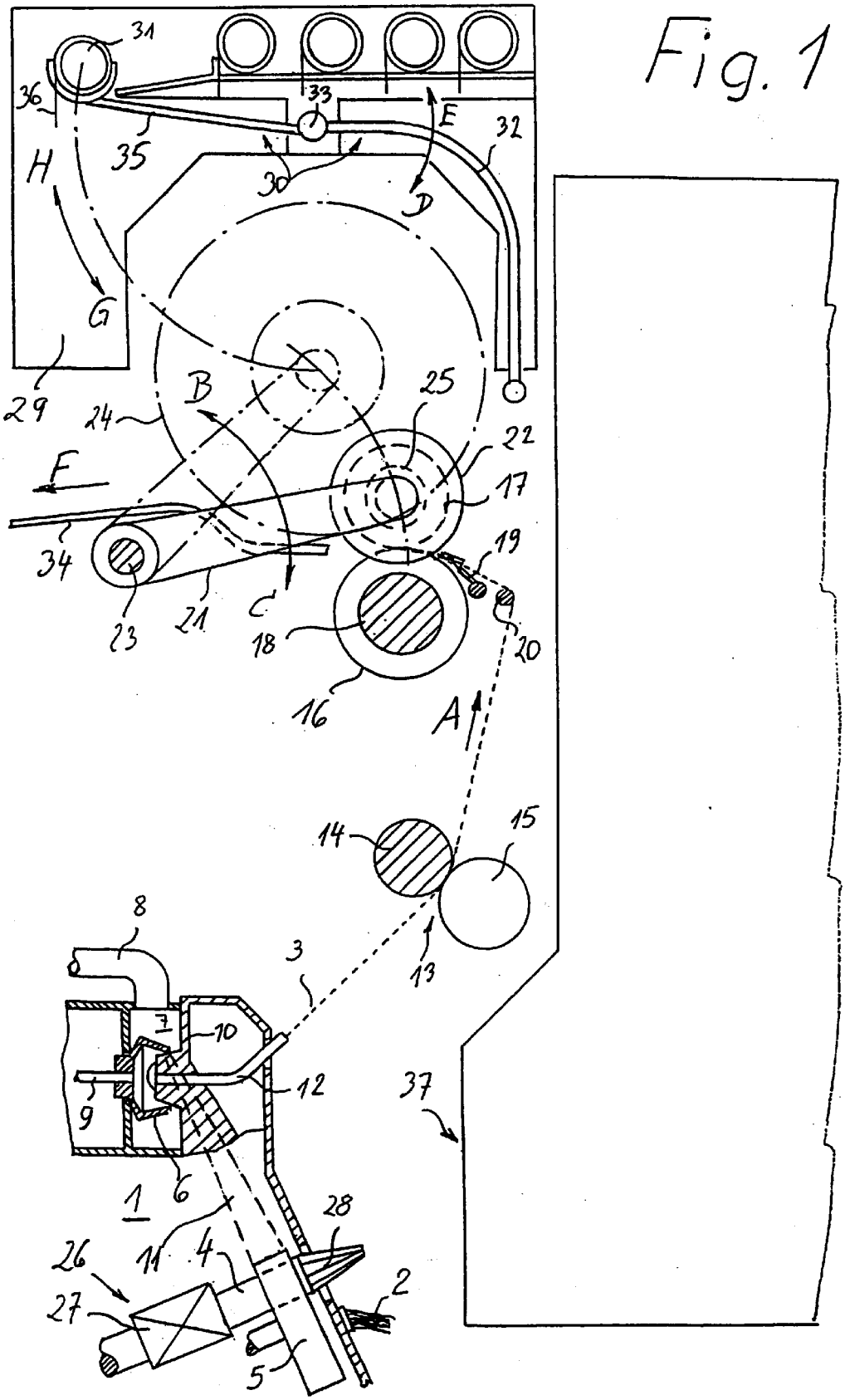
FIG. 1 is a part, sectional side view of a spinning station of an open-end rotor spinning machine, of a doffing arrangement and of a piecing arrangement before re-equipping and modernization.

The open-end rotor spinning machine as shown in FIG. 1, which is to be re-equipped and modernized, comprises a plurality of spinning stations 1, which are arranged adjacently on each machine side. In the known way, a yarn 3, denoted by a dotted line, is spun from a fed sliver 2 at these spinning stations 1.

Each spinning station 1 comprises a feed roller 4 for feeding the sliver 2, an opening roller 5 for separating the sliver 2 into single fibers, as well as a spinning rotor 6, in which the single fibers are collected together in a fiber ring and spun to a yarn 3. The spinning rotor 6 rotates in a vacuum chamber 7, which is connected to a suction conduit 8. The shaft 9 connected to the spinning rotor 6 is supported and driven in a way not shown here.

During operation the vacuum chamber 7 is closed by means of a covering 10, which comprises, in the known way, a fiber feed channel 11 for feeding the single fibers to the spinning rotor 6 as well as a yarn withdrawal duct 12 for withdrawing the spun yarn 3.

The yarn 3 is withdrawn in withdrawal direction A during operation by means of a delivery roller pair 13, which is a part of the spinning station 1 and which consists of a drive shaft 14 extending along the length of the machine in longitudinal direction, and a pressure roller 15. The withdrawn yarn 3 reaches a winding roller 16, which also belongs to the spinning station 1 and on which the bobbin 17 for winding yarn is placed. The winding roller 16, connected to a drive shaft 18 extending along the machine in longitudinal direction, drives the bobbin 17 to rotate, so that under the action of a traversing yarn guide 19, a cross package is generated. A deflecting yarn guide 20 is located-upstream of the winding roller 16 to balance the tension.

During operation, the rotating bobbin 17 is supported in a bobbin carrier 21 which also belongs to the spinning station 1, which bobbin carrier 21 comprises a bobbin plate 22 on each side of the bobbin 17. The bobbin carrier 21 can be swivelled around a stationary swivel axle 23, so that, with ever-increasing fullness, the bobbin carrier 21 can swivel away upwards from the winding roller 16, whereby the bobbin 17 is continuously driven by the winding roller 16. The swivel directions of the bobbin carrier 21 are denoted by B and C.

When the degree of fullness has been reached, the full bobbin 24, denoted by a dot-dash line, must be exchanged for a new empty yarn-winding tube 25. The desired degree of fullness is reached when—controlled by means of a length measuring device for the spun yarn 3, for example—a relevant signal is given. In this case, the full bobbin 24 is raised, as shown, in the known way from the winding roller 16, so that the bobbin 24 is no longer driven. At the same time, the spinning process at the spinning station 1 has to be interrupted.

The spinning station 1 comprises for this purpose means 26 for interrupting the spinning process. These means 26 can comprise a coupling 27, by means of which the feed roller 4 can be separated from a drive (not shown). In order, however, to be able to drive the feed roller 4 temporarily, despite the interrupted operation, for the purpose of a subsequent piecing, the feed roller 4 is connected to a driving pinion 28 for an external drive, which driving pinion 28 projects out of the spinning station 1 towards the operator's side.

A doffing operation is carried out by means of a doffing arrangement 29, which travels relative to the spinning stations 1 on running wheels along running rails. The doffing arrangement 29 comprises devices 30 for exchanging a full bobbin 24 for an empty yarn-winding tube 31, which is carried by the doffing arrangement 29.

In order to remove the full bobbin 24 from the bobbin carrier 21, the doffing arrangement 29 comprises an ejector 32, which can be swivelled around a swivel axle 33 of the doffing arrangement 29 according to the swivel directions D and E. The relevant drive is not shown. The bobbin carrier 21 is hereby opened laterally, so that the full bobbin 24 can roll by means of a slide 34 in the spinning station 1 in direction F onto a transport belt (not shown). The full bobbin 24 can be transported by means of this transport belt for further processing at the machine end.

The doffing arrangement 29 comprises further a tube gripper 35, which can also, for example, be swivelled around said swivel axle 33 according to the swivel directions G and H, whereby the drive is also not shown here. By means of the tube gripper 35, a new empty yarn-winding tube 31 can be applied to the bobbin carrier 21, as is the case in the above described open-end rotor spinning machine from the firm Schlafhorst.

As, in the case of the open-end spinning machine to be re-equipped, the spinning process is interrupted for the purpose of the doffing operation, it must be possible for the spinning process to start again. This occurs in the open-end rotor spinning machine to be re-equipped in that each new empty tube 31 is connected to a starting yarn 36, which is at least long enough for a piecing operation. The piecing itself occurs in the open-end rotor spinning machine to be re-equipped by means of a piecing arrangement 37, of which only the outer contour is shown, as this piecing arrangement 37 is to be replaced by another piecing arrangement 38 (see also FIG. 2). The former piecing arrangement 37 can also travel along the spinning stations 1 and is designed to piece the starting yarn 36 connected to the new tube 31 at the spinning station 1.

As a consequence of the starting yarn 36 connected to the new tube 31 for winding yarn, each new bobbin 17 is provided at the beginning of being wound with yarn with an additional, and for the prior process necessary, piecing point. Even if such a piecing point is not an actual fault, it does bring down in a certain way the quality of the bobbin 17. Therefore it is provided to re-equip and thus modernize open-end rotor spinning machines, already in operation, of the above described type in such a way that the starting yarn 36 can be omitted, and that in the course of which the current piecing arrangement 37 is replaced with a new piecing arrangement 38, whereby the doffing arrangement 29 can be retained. The re-equipped and thus modernized open-end rotor spinning machine is described below with the aid of FIG. 2.

The new piecing arrangement 38 is designed, in a way to be described below, to piece a starting yarn 52 that is not connected to a yarn-winding tube 39 and subsequently to connect a newly spun yarn 57 to the yarn-winding tube 39. The current doffing arrangement 29 can therefore be retained, as it is irrelevant for this aggregate how the new tubes 39 are provided. It is of no consequence for the doffing arrangement 29 when the starting yarn 36 is no longer present on the empty tubes 39.

It should be noted at this point that—as far as the spinning station 1 is concerned—the reference numbers will be retained so long as the same components are involved. A repeat description is therefore not necessary.

Figure 2:
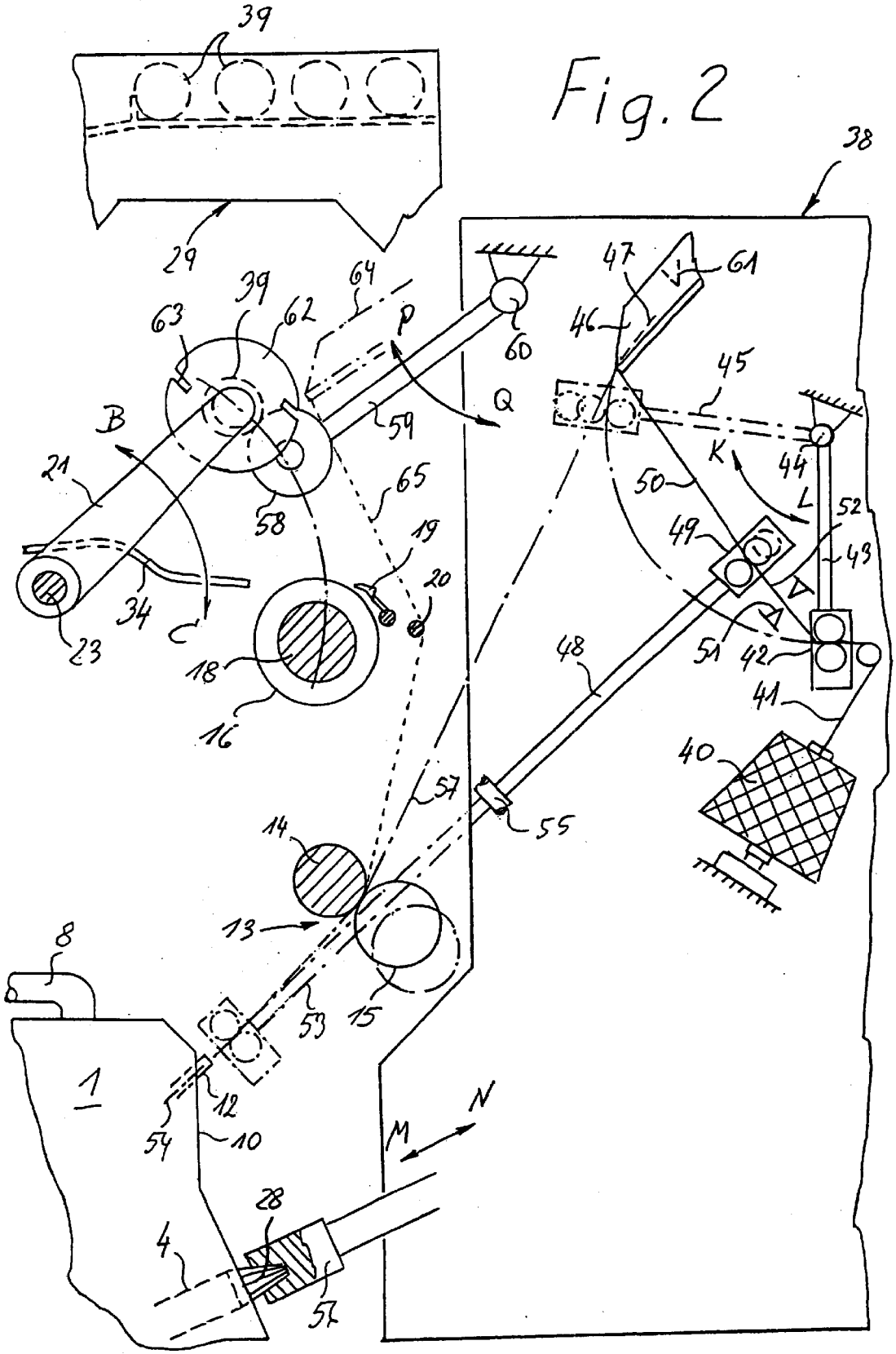
FIG. 2 is the same spinning station after re-equipping, whereby the previous piecing arrangement is replaced by a new piecing arrangement, while, however, the previous doffing arrangement is retained.

The new piecing arrangement 38 according to FIG. 2 constantly carries an auxiliary bobbin 40 with it, from which an auxiliary yarn 41 for piecing during doffing operations can be unwound. The nature of the auxiliary yarn 41 is not relevant in itself, as it is eliminated anyway before yarn is wound onto the new tube 39. The auxiliary yarn 41 need only be suitable for piecing, but it also needs, in particular, to be sufficiently strong.

The auxiliary yarn 41 is continuously nipped by means of an auxiliary yarn delivery device 42 of the new piecing arrangement 38. The auxiliary yarn delivery device 42 is arranged at a swivel lever 43. which can be swivelled around a swivel axle 44 of the piecing arrangement 38 by means of a drive (not shown). The swivel directions are denoted by K and L.

In connection with a piecing process, necessary after a doffing operation, the swivel lever 43 swivels to a position 45, denoted by a dot-dash line, in close proximity to a suction nozzle 46. The auxiliary yarn delivery device 42 is driven during this action. The suction nozzle 46 can thereafter seize and suction the auxiliary yarn end 47 of the auxiliary yarn 41. In any case, that which is necessary for the piecing operation is suctioned.

Now the auxiliary yarn delivery device 42 is opened and swivels back into the starting position denoted by a continuous line, that is, in close proximity to the auxiliary bobbin 40. Thus a further swivel lever 48, which comprises a piecing delivery roller pair 49 at its end, can swivel in the auxiliary yarn line 50 between the suction nozzle 46 and the auxiliary yarn delivery device 42, as shown by continuous lines. The at first opened piecing delivery roller pair 49 is closed after the auxiliary yarn 41 has been seized, so that the latter is nipped.

A yarn cutter 51 located between the piecing delivery roller pair 49 and the auxiliary yarn delivery device 42 creates a starting yarn 52 for piecing. The rest of the starting yarn remains, as mentioned above, in the inside of the suction nozzle 46.

Now the swivel lever 48 can, together with the starting yarn 52, swivel into a piecing position 53 shown by a dot-dash line, in which position 53 the piecing delivery roller pair 49 is adjacent to the yarn withdrawal duct 12. The piecing delivery roller pair 49 is turnable relative to the swivel lever 48 during the swivel movement, so that the starting yarn 52 for piecing can be brought into a piecing position 54. A swivel axle 55 is provided for this swivel movement of the swivel lever 48. The swivel movement takes place outside of the plane of the drawing.

Controlled by means of a control device (not shown), the piecing delivery roller pair 49 delivers the starting yarn 52 for piecing back to the spinning rotor 6, where it is joined to a fiber ring located there. The fiber ring can be created in that the feed roller 4 is temporarily driven by the driving pinion 28 by means of an external drive 56 of the piecing arrangement 38. The external drive 56 can be arranged to the driving pinion 28 in arrow direction M, and can later be removed in arrow direction N. Controlled by means of the control device (not shown), the piecing roller delivery pair 49, in the known way and at the right moment, pulls the pieced yarn out of the spinning rotor 6 again, which yarn, as before, runs in the suction nozzle 46. The pieced yarn runs so long in the suction nozzle 46 until the auxiliary yarn 41 necessary for piecing is suctioned off completely. Thus the auxiliary yarn 41 can be eliminated.

As soon as a newly spun yarn 57 with the correct yarn count leaves the yarn withdrawal duct 12, the piecing delivery roller pair 49 transfers the newly spun yarn 57 into the open yarn withdrawal roller pair 13 located on the side of the machine, which roller pair 13 is thereafter closed. The piecing delivery roller pair 49 opens at the same time and swivels out laterally.

During the above described piecing process, the newly applied empty tube 39 is continuously raised from its winding roller 16 and is disposed temporarily on an auxiliary winding roller 58 of the piecing arrangement 38. The tube 39 can hereby be driven in a controlled way by the auxiliary winding roller 58.

A cutter device 61 located in the suction nozzle 46 cuts the spun yarn 57 which still runs into the suction nozzle 46. In a known way, which, for example, is described in the U.S. Pat. No. 5,676,322, the separated spun yarn 57 can now be wound laterally onto the tube 39 to form a yarn reserve winding, while the separated end in the suction nozzle 46 can be removed as waste. In order that this yarn reserve can be generated, the current bobbin plate 22 is exchanged for a new bobbin plate 62, which is provided with catching slits 63.

The guiding of the spun yarn 57, shown by a dot-dash line, to the catching slits 63 occurs by means of the suction nozzle 46, which is movable in a position 64 for this purpose in a way not shown. The spun yarn 57 takes up the path 65, shown by the dotted line, which leads from the yarn withdrawal duct 12 through the withdrawal roller pair 13 and, by means of the deflecting yarn guide 20, to the empty tube 39 placed in the bobbin carrier 21. The bobbin carrier 21 can thereafter be lowered again in arrow direction C, until the tube 39 is placed onto its winding roller 16. The yarn hereby gets into the continuously moving traverse yarn guide 19.

The new piecing arrangement 38 differs from the previous piecing device 37 essentially in that the starting yarn 52 to be pieced is connected to an auxiliary bobbin 40 carried in the new piecing arrangement 38, said starting yarn being eliminated after piecing, whereafter the newly spun yarn 57 is connected to the empty tube 39 for winding yarn. In this process the piecing point is completely eliminated and does not reach the empty tube 39 for winding yarn.

The new piecing arrangement 38 also facilitates piecing in the case of a yarn break with a partially full tube where the tubes are not exchanged. During this mode of operation, the yarn end to be returned for piecing with the fiber ring in the rotor is pulled from the already spun yarn on the tube, for example, by appropriate movement and operation of the suction nozzle 64, and then piecing takes place in a similar manner as with prior art arrangements of the type described herein. For these piecing operations, the auxiliary yarn 41 is not needed or used.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A procedure for re-equipping and simultaneously modernizing an open-end rotor spinning machine, said machine comprising:

a plurality of spinning stations, a doffing arrangement movable in relation to the spinning stations, said doffing arrangement having devices for exchanging a full bobbin for an empty yarn-winding tube, means for interrupting the spinning process of a spinning station for the purpose of a doffing operation, and at least one piecing arrangement movable relative to the spinning stations and designed to piece a starting yarn at the spinning station after yarn-winding tube doffing operations with a new empty tube being exchanged for a full tube, which starting yarn is already connected to the empty yarn-winding tube, said procedure comprising replacing the piecing arrangement with a new piecing arrangement which is designed to accommodate piecing at a new empty tube which does not have a starting yarn connected thereto subsequently to connect a newly spun yarn to the empty yarn-winding tube.

2. A procedure according to claim 1, wherein the starting yarn in the new piecing arrangement for piecing after doffing operations is connected to an auxiliary bobbin carried in the new piecing arrangement and which starting yarn is subsequently eliminated, whereafter the newly spun yarn is connected to the empty yarn-winding tube.

3. A procedure according to claim 2, wherein the new piecing arrangement is also operable to carry out piecing operations with a partially full tube by using yarn from the partially full tube as the starting yarn.

4. A procedure according to claim 1, wherein the new piecing arrangement is also operable to carry out piecing operations with a partially full tube by using yarn from the partially full tube as the starting yarn.

5. Apparatus for re-equipping and simultaneously modernizing an open-end rotor spinning machine, said machine comprising:

a plurality of spinning stations, a doffing arrangement movable in relation to the spinning stations, said doffing arrangement having devices for exchanging a full bobbin for an empty yarn-winding tube, means for interrupting the spinning process of a spinning station for the purpose of a doffing operation, and at least one piecing arrangement movable relative to the spinning stations and designed to piece a starting yarn at the spinning station after yarn wind up tube doffing operations with a new empty tube being exchanged for a full tube, which starting yarn is already connected to the empty yarn-winding tube, wherein the piecing arrangement is replaced by a new piecing arrangement which is designed to accommodate piecing at a new empty tube which does not have a starting yarn connected thereto and subsequently to connect a newly spun yarn to the empty yarn-winding tube.

6. Apparatus according to claim 5, wherein the starting yarn in the new piecing arrangement for piecing after doffing operations is connected to an auxiliary bobbin carried in the new piecing arrangement and which starting yarn is subsequently eliminated, whereafter the newly spun yarn is connected to the empty yarn-winding tube.

7. Apparatus according to claim 5, wherein the new piecing operation is also operable to carry out piecing arrangement with a partially full tube by using yarn from the partially full tube as the starting yarn.

8. Apparatus according to claim 7, wherein the starting yarn in the new piecing arrangement for piecing after doffing operations is connected to an auxiliary bobbin carried in the new piecing arrangement and which starting yarn is subsequently eliminated, whereafter the newly spun yarn is connected to the empty yarn-winding tube.

* * * * *